United States Patent [19]

Steiner et al.

[11] Patent Number: 4,993,151

[45] Date of Patent: Feb. 19, 1991

[54] METHOD OF MAKING AN EASILY REMOVED MARINE PROPELLER

[75] Inventors: Ronald M. Steiner; Roger E. Koepsel, both of Oshkosh; Hubert S. Gilgenbach, Butte des Morts; Terence C. Reinke, Oshkosh, all of Wis.

[73] Assignee: Brunswick Corporation, Skokie, Ill.

[21] Appl. No.: 514,128

[22] Filed: Apr. 25, 1990

Related U.S. Application Data

[63] Continuation of Ser. No. 114,459, Oct. 28, 1987, Pat. No. 4,925,369.

[51] Int. Cl.[5] ..... B21D 53/00

[52] U.S. Cl. ..... 29/889.6; 29/428; 29/527.6; 29/557; 29/889

[58] Field of Search ..... 29/889, 889.6, 527.6, 29/557, 428; 409/143, 131, 132; 279/102, 103; 416/204 R

[56] References Cited

U.S. PATENT DOCUMENTS

| | | | |
|---|---|---|---|
| 823,640 | 6/1906 | Schulze | 279/103 |
| 1,959,901 | 5/1934 | Buehle . | |
| 2,351,356 | 6/1944 | Meyer . | |
| 2,618,180 | 11/1952 | Lunden et al. | 279/103 |
| 2,862,733 | 2/1958 | Reiersen . | |
| 3,061,342 | 10/1962 | Feller . | |
| 3,104,459 | 9/1963 | Wendt | 29/889 |
| 3,307,634 | 3/1967 | Bihlmire . | |
| 3,354,529 | 11/1967 | James | 29/889 |
| 3,469,556 | 9/1969 | Campbell et al. . | |
| 3,759,536 | 9/1973 | Bronzini | 279/103 |
| 4,375,926 | 3/1983 | Feller . | |
| 4,879,793 | 11/1989 | Stuecker et al. | 29/889 |

FOREIGN PATENT DOCUMENTS

| | | |
|---|---|---|
| 6505591 | 5/1965 | Netherlands . |
| 229993 | 2/1969 | U.S.S.R. . |
| 569753 | 4/1974 | U.S.S.R. . |
| 488028 | 10/1975 | U.S.S.R. . |
| 611805 | 6/1978 | U.S.S.R. . |
| 956349 | 9/1982 | U.S.S.R. . |
| 1013346 | 4/1983 | U.S.S.R. . |
| 317469 | 7/1929 | United Kingdom . |

*Primary Examiner*—Howard N. Goldberg
*Assistant Examiner*—I. Cuda
*Attorney, Agent, or Firm*—Andrus, Sceales, Starke & Sawall

[57] ABSTRACT

In a marine drive having a tapered propeller shaft section (14) and a tapered propeller hub (20, 60) matching and fitting therearound in flush contact, a relief inner diameter section (28, 66) is provided in the hub, spaced from the propeller shaft, to prevent flush contact and facilitate removal of the propeller hub from the propeller shaft. In a further embodiment, a thrust collar (50) with a substantially steeper tapered section (56) further facilitates removal.

1 Claim, 2 Drawing Sheets

METHOD OF MAKING AN EASILY REMOVED MARINE PROPELLER

CROSS REFERENCE TO RELATED APPLICATION

This is a continuation of application Ser. No. 07/114,459, filed Oct. 28, 1987 now U.S. Pat. No. 4,925,369.

BACKGROUND AND SUMMARY

The invention relates to mounting arrangements for marine propellers.

In an inboard marine drive, the propeller has a hub with a tapered inner diameter mounted to the end of the propeller shaft which is also tapered. The tapers are matched and provide flush contact between the propeller hub and the propeller shaft. To remove the propeller, a puller is needed, together with a significant amount of manual labor. This difficulty of removal persists even if lubricant is spread on the surfaces, because the lubricant is usually squeezed out during assembly.

The present invention addresses and solves the above noted removal problem.

DETAILED DESCRIPTION

Prior Art

Figure 1:
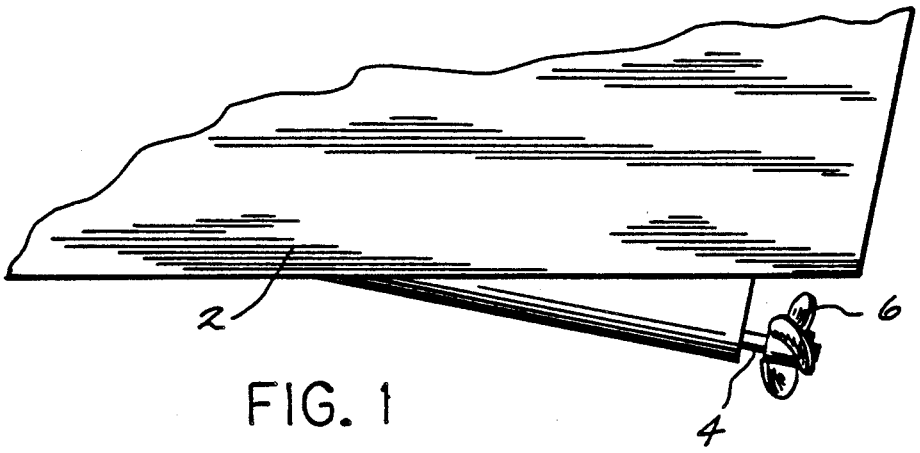
FIG. 1 shows a portion of an inboard marine drive.
Figure 2:
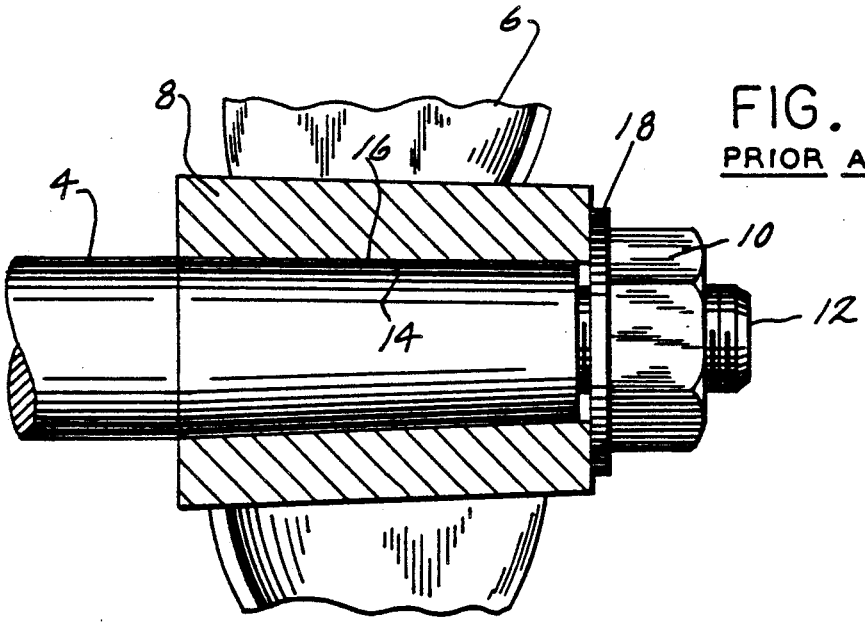
FIG. 2 PRIOR ART
FIG. 2 shows a propeller mounting arrangement known in the prior art.

FIG. 1 shows an inboard marine drive including a boat hull 2 having a driven propeller shaft 4 extending therefrom. A propeller 6 having a propeller hub 8, FIG. 2, is mounted to propeller shaft 4 by nut 10 on threaded end 12 of the propeller shaft. Propeller shaft 4 has a tapered outer diameter section 14 receiving propeller hub 8 therearound. A standard taper is 1/16th inch per one inch length of shaft. Propeller hub 8 has a tapered inner diameter section 16 substantially matching and fitting around the propeller shaft at taper 14 and in flush contact therewith. Nut 10 bears against washer 18 which retains hub 8 on tapered section 14 of the propeller shaft. This arrangement is subject to the above noted problems with removal.

Present Invention

Figure 3:
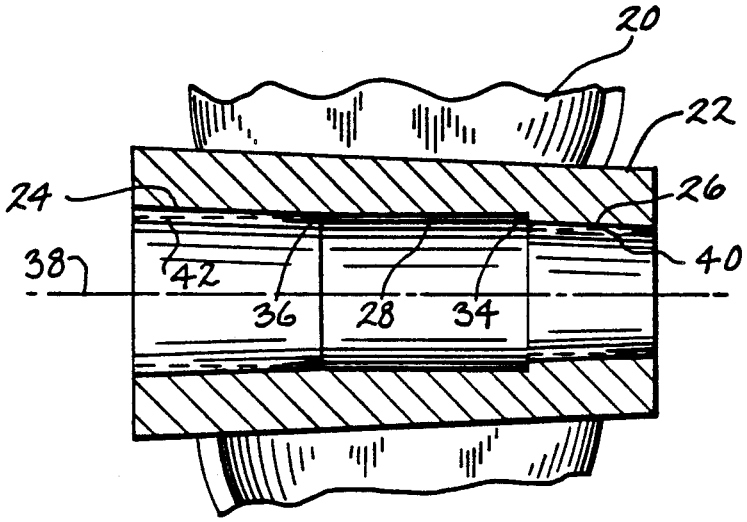
FIG. 3 shows a propeller hub in accordance with the invention.
Figure 4:
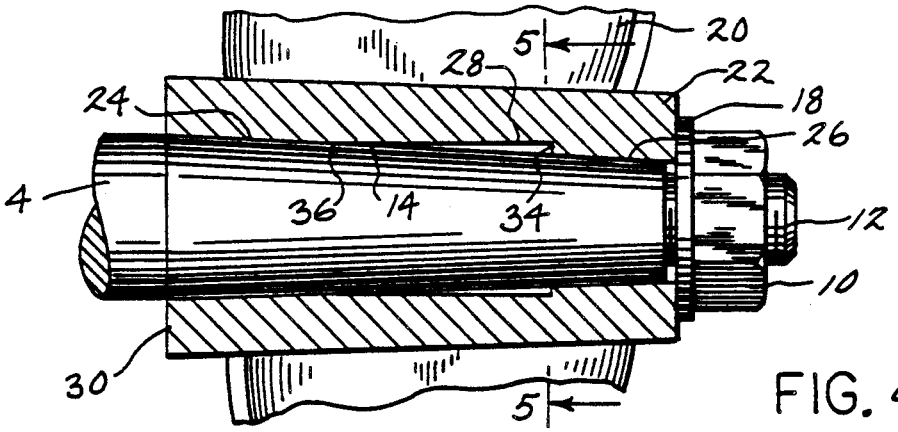
FIG. 4 shows the propeller hub of FIG. 3 mounted to a propeller shaft.
Figure 5:
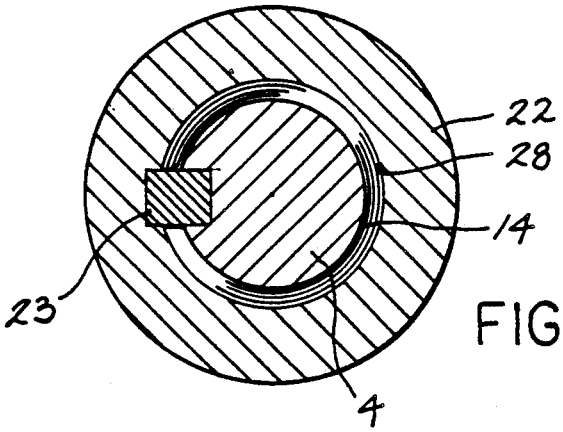
FIG. 5 is a sectional view taken along line 5—5 of FIG. 4.

FIGS. 3–5 show a propeller mounting arrangement in accordance with the invention and use like reference numerals from FIGS. 1 and 2 where appropriate to facilitate clarity. FIG. 3 shows a propeller 20 having a propeller hub 22 with inner diameter sections 24 and 26 substantially matching and fitting around propeller shaft 4 at taper 14, FIG. 4, and in flush contact therewith. Propeller hub 22 is retained on propeller shaft 4 by nut 10 and washer 18, as in FIG. 2. Propeller hub 22 is keyed to propeller shaft 4 by key 23, FIG. 5, as is standard in the prior art.

Propeller hub 22 has an inner diameter relief section 28 spaced from propeller shaft taper section 14 to prevent flush contact therewith and facilitate removal of propeller hub 22 from propeller shaft 4. Relief section 28 reduces the total area of flush contact between the propeller hub and the propeller shaft. This reduces the contact force and friction which must be overcome to remove the propeller. It has been found that a puller is not needed, even if no lubricant has been applied. The operator merely strikes the forward face 30 of the propeller hub with a drift punch or similar device. Furthermore, if lubricant is used, relief section 28 enables some lubricant to remain after installation, which further facilitates ease of removal.

Forward and rearward inner diameter tapered sections 24 and 26, respectively, of the propeller hub are in flush contact with the propeller shaft tapered section 14. Inner diameter relief section 28 of the propeller hub is between forward and rearward sections 24 and 26. Relief section 28 meets rearward section 26 at an annular step reduction shoulder interface 34. Relief section 28 meets forward section 24 at a transition angle 36 interrupting the taper of the inner diameter of propeller hub 22.

Propeller hub 22 has a central axis 38, FIG. 3, coincident with the rotational axis of propeller shaft 4. Forward section 24 of the inner diameter of the propeller hub extends rearwardly and tapers inwardly toward propeller shaft axis 38. Relief section 28 of the inner diameter of the propeller hub extends from forward section 24 rearwardly and parallel to propeller shaft axis 38 such that the radial gap between the propeller shaft taper section 14 and relief section 28 increases as the relief section extends rearwardly. Rearward section 26 of the inner diameter of the propeller hub extends rearwardly from relief section 28 and tapers inwardly toward propeller shaft axis 38.

Propeller hub 22 is formed as a cast member having a first inner diameter cast section 40, as shown in dashed line in FIG. 3, and a second larger inner diameter cast section 42 meeting first section 40 at annular step reduction shoulder 34. The inner diameter of hub 22 is machined to provide tapered rearward section 26 at first section 40, and to provide tapered forward section 24 at the forward portion of second section 42.

Figure 6:
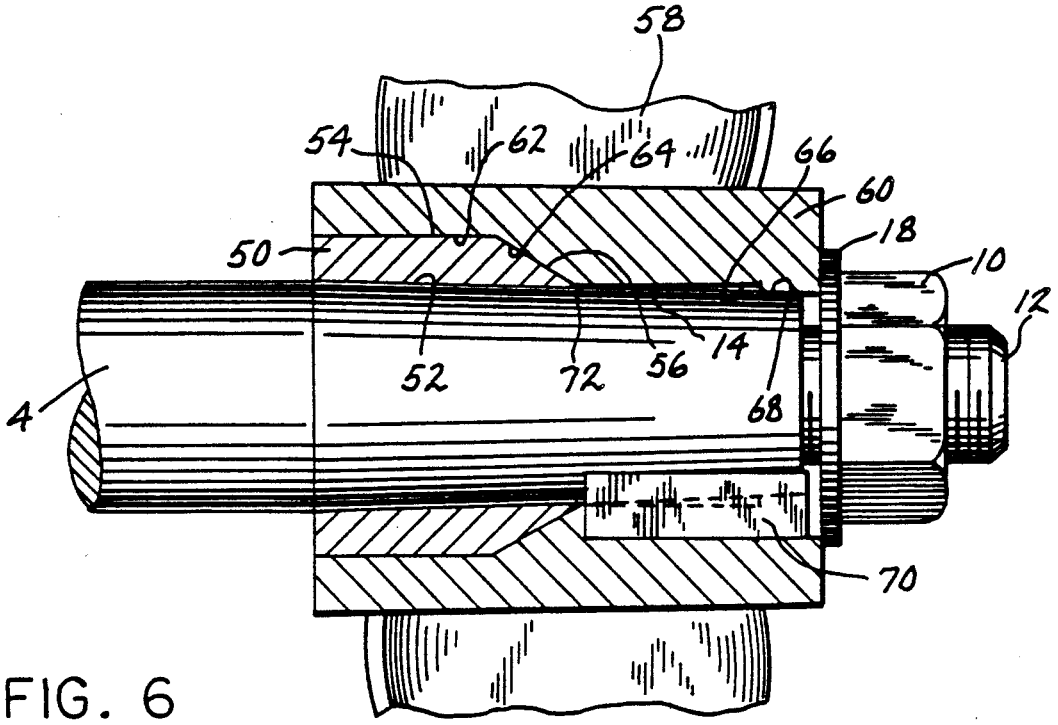
FIG. 6 shows an alternate embodiment of a propeller mounting arrangement in accordance with the invention.

FIG. 6 shows an alternate embodiment in accordance with the invention, and uses like reference numerals from FIGS. 1–5 where appropriate to facilitate clarity. A thrust collar 50 is provided around tapered section 14 of propeller shaft 4. Collar 50 has a tapered inner diameter 52 substantially matching and fitting around propeller shaft taper section 14 and in flush contact therewith. Thrust collar 50 has a forward section 54 of constant outer diameter, and a rearward section 56 of tapered outer diameter, which taper is substantially steeper than the taper of inner diameter 52 and propeller shaft taper 14.

Propeller 58 has a propeller hub 60 received around collar 50 and propeller shaft taper section 14. Propeller hub 60 has a forward enlarged inner diameter section 62 engaging the outer diameter of forward section 54 of the collar. Propeller hub 60 has a forward tapered inner diameter section 64 of the noted substantially steeper taper engaging the outer diameter of the rearward collar section 56. Propeller hub 60 has an intermediate relief inner diameter section 66 spaced from propeller shaft taper section 14 to prevent flush contact therewith. Propeller hub 60 has a rearward tapered inner diameter section 68 substantially matching and fitting around propeller shaft taper section 14 and in flush contact therewith. Propeller hub 60 is keyed to the propeller shaft by key 70 extending axially along rearward section 68 and intermediate section 66 of the propeller hub but not along collar 50. Collar 50 is not keyed to propeller shaft 4 nor to propeller hub 60.

Relief section 66 of propeller hub 60 and the steeper taper of the rearward collar section 56 and hub inner diameter section 64 facilitate removal of propeller hub 60 from propeller shaft 4. Steeply tapered collar section 56 meets the inner diameter collar tapered section 52 at the latter's intersection 72 with relief section 66, which intersection forms the inner diameter transition angle, comparably to angle 36 in FIG. 3.

It is recognized that various equivalents, alternatives and modifications are possible within the scope of the appended claims.

We claim:

1. A method of making a propeller hub for a marine drive having a propeller shaft with a tapered outer diameter receiving said propeller hub therearound, the method comprising providing a propeller hub with a two stage bore having a first section of given inner diameter and a second section of larger inner diameter than said given inner diameter, machining said bore along a taper angle to form a first tapered inner diameter section at the first bore section for flush contact with said propeller shaft, a second tapered inner diameter section at said second bore section for flush contact with said propeller shaft, and a central inner diameter section at said second bore section and between said first and second tapered inner diameter sections, said central inner diameter section meeting said second tapered inner diameter section at a transition angle defined by said taper angle of said machining, mounting said propeller hub on said propeller shaft, said central inner diameter section meeting said first tapered inner diameter section at the interface between said first and second bore sections, said central inner diameter section being spaced from said propeller shaft by a maximum gap at said interface, and by no gap at said transition angle.

* * * * *